US008931811B1

(12) United States Patent
Ng

(10) Patent No.: US 8,931,811 B1
(45) Date of Patent: Jan. 13, 2015

(54) MONSTER TAIL LOOM FOR FORMING BRUNNIAN LINKS

(71) Applicant: Choon's Design Inc., Wixom, MI (US)

(72) Inventor: Cheong Choon Ng, Novi, MI (US)

(73) Assignee: Choon's Design Inc., Wixom, MI (US)

( * ) Notice: Subject to any disclaimer, the term of this patent is extended or adjusted under 35 U.S.C. 154(b) by 0 days.

(21) Appl. No.: 14/226,096

(22) Filed: Mar. 26, 2014

Related U.S. Application Data

(60) Provisional application No. 61/877,490, filed on Sep. 13, 2013.

(51) Int. Cl.

| | |
|---|---|
| ***B65H 69/04*** | (2006.01) |
| ***A44C 5/00*** | (2006.01) |
| ***A44C 27/00*** | (2006.01) |
| ***D04B 3/00*** | (2006.01) |

(52) U.S. Cl.
CPC ..... *A44C 5/0069* (2013.01); *A44C 27/00* (2013.01); *D04B 3/00* (2013.01)
USPC ..... 289/17

(58) Field of Classification Search
USPC ..... 289/2, 16.5, 17, 18.1; 273/281, 288, 273/309; D21/334
See application file for complete search history.

(56) References Cited

U.S. PATENT DOCUMENTS

| | | | |
|---|---|---|---|
| 222,937 | A | 12/1879 | Newcomb |
| 246,648 | A | 9/1881 | Wilcox |
| 254,258 | A | 2/1882 | Barbour |
| 254,288 | A | 2/1882 | Dimmick |
| 289,578 | A | 12/1883 | Stewart |
| 426,087 | A | 4/1890 | Wolkow |
| 782,657 | A | 2/1905 | Hubert |
| 843,495 | A | 2/1907 | Sander |
| 968,199 | A | 8/1910 | Schwartz |
| 1,020,963 | A | 3/1912 | Cake |
| 1,073,226 | A | 9/1913 | Freeman |
| 1,176,482 | A | 3/1916 | Orme |
| 1,279,411 | A | 9/1918 | Neuman |
| 1,318,465 | A | 10/1919 | Seifarth |
| 1,318,604 | A | 10/1919 | Schneider |
| 1,366,212 | A | 1/1921 | Pollard |
| 1,375,119 | A | 4/1921 | Stephen |
| 1,405,744 | A | 2/1922 | Sampliner |

(Continued)

FOREIGN PATENT DOCUMENTS

| | | |
|---|---|---|
| GB | 2147918 | 5/1985 |
| JP | 2003-520083 | 7/2003 |

(Continued)

OTHER PUBLICATIONS

How to make a fishtail rainbow loom bracelet; http://www.youtube.com/watch?v=ukv83Cvq3jk; Jul. 13, 2013.*

(Continued)

*Primary Examiner* — Shaun R Hurley
(74) *Attorney, Agent, or Firm* — Carlson, Gaskey & Olds, P.C.

(57) ABSTRACT

A kit for creating Brunnian link items such as bracelets, necklaces and other wearable or decorative items is disclosed and includes a loom, a hook, and a plurality of clips and a plurality of elastic bands. The loom includes a base supporting a plurality of upward extending pins. Each of the pins includes a flange for holding an elastic band in a desired orientation.

16 Claims, 3 Drawing Sheets

(56) References Cited

U.S. PATENT DOCUMENTS

| | | | |
|---|---|---|---|
| 1,424,458 | A | 8/1922 | Fleisher |
| 1,500,383 | A | 7/1924 | Gourie |
| 1,599,040 | A | 9/1926 | Clisby |
| 1,647,060 | A | 10/1927 | Speidel |
| 1,694,849 | A | 12/1928 | Fujii |
| 1,705,860 | A | 3/1929 | Hagihara |
| 1,718,140 | A | 6/1929 | Hagihara |
| 1,776,561 | A | 9/1930 | La Croix |
| 1,994,659 | A | 3/1935 | De A Mascarenhas |
| 2,072,668 | A | 3/1937 | Eltgroth |
| 2,108,424 | A | 2/1938 | Bakely |
| 2,134,066 | A | 10/1938 | Van Ness |
| 2,186,692 | A | 1/1940 | Boyer et al. |
| 2,270,619 | A | 1/1942 | Bowyer |
| 2,274,572 | A | 2/1942 | Yates |
| 2,318,018 | A | 5/1943 | Semonsen |
| 2,360,416 | A | 10/1944 | Gray |
| 2,433,307 | A | 12/1947 | Thomas |
| 2,450,067 | A | 9/1948 | Wolff |
| 2,457,064 | A | 12/1948 | Parisi |
| 2,540,383 | A | 2/1951 | Tillert et al. |
| 2,545,409 | A | 3/1951 | McCall |
| 2,658,364 | A | 11/1953 | Carlson |
| 2,666,249 | A | 1/1954 | Ruiz et al. |
| 2,687,630 | A | 8/1954 | Carlson |
| 2,703,482 | A | 3/1955 | Auran |
| 2,707,052 | A | 4/1955 | Brown |
| 2,726,434 | A | 12/1955 | Knoblock et al. |
| 2,984,488 | A | 5/1961 | Kirchner |
| 3,054,214 | A | 9/1962 | Smith et al. |
| 3,069,739 | A | 12/1962 | Jorgenson et al. |
| 3,112,491 | A | 12/1963 | Cleveland |
| D204,442 | S | 4/1966 | Brawley, Jr. |
| 3,377,674 | A | 4/1968 | Brassaw et al. |
| 3,438,098 | A | 4/1969 | Grabner |
| 3,438,223 | A | 4/1969 | Linstead |
| 3,476,423 | A | 11/1969 | Kentfield |
| 3,476,426 | A | 11/1969 | Lewin |
| 3,572,679 | A | 3/1971 | Strauff |
| 3,636,987 | A | 1/1972 | Forby |
| 3,648,484 | A | 3/1972 | Gordon |
| 3,665,971 | A | 5/1972 | Ileks |
| 3,672,679 | A | 6/1972 | Burns |
| 3,678,709 | A | 7/1972 | Nowicki et al. |
| 3,688,357 | A | 9/1972 | Nielsen et al. |
| 3,693,976 | A | 9/1972 | Flack |
| 3,728,762 | A | 4/1973 | Hogg |
| 3,748,706 | A | 7/1973 | Doyel |
| 3,758,923 | A | 9/1973 | Maude |
| 3,800,372 | A | 4/1974 | Daoust |
| 3,805,345 | A | 4/1974 | Antos |
| 3,853,021 | A | 12/1974 | Hayes |
| 3,905,133 | A | 9/1975 | Charman |
| 4,018,543 | A | 4/1977 | Carson et al. |
| 4,023,245 | A | 5/1977 | Zaltzman |
| 4,032,179 | A | 6/1977 | Goss |
| 4,037,513 | A | 7/1977 | Hobson |
| 4,066,271 | A | 1/1978 | Lohr |
| D248,347 | S | 7/1978 | McCollum |
| 4,114,892 | A | 9/1978 | Csoka |
| 4,131,138 | A | 12/1978 | Boisvert |
| 4,179,129 | A | 12/1979 | Loomis |
| 4,248,063 | A | 2/1981 | Wang |
| 4,416,040 | A | 11/1983 | Towsley |
| 4,569,108 | A | 2/1986 | Schwab |
| 4,629,100 | A | 12/1986 | Owens |
| 4,667,965 | A | 5/1987 | Helms, Jr. |
| 4,680,021 | A | 7/1987 | Maxim |
| 4,729,229 | A | 3/1988 | Whicker |
| 4,844,473 | A | 7/1989 | Landsberg |
| D310,672 | S | 9/1990 | Harvey et al. |
| D330,668 | S | 11/1992 | Nagamatsu |
| 5,163,946 | A | 11/1992 | Li |
| 5,231,742 | A | 8/1993 | Macbain |
| 5,295,280 | A | 3/1994 | Hudson et al. |
| 5,328,374 | A | 7/1994 | Stevens |
| 5,331,725 | A | 7/1994 | Chou |
| 5,377,595 | A | 1/1995 | Liu |
| 5,426,788 | A | 6/1995 | Meltzer |
| 5,437,459 | A | 8/1995 | Kirby |
| 5,459,905 | A | 10/1995 | Voyre |
| 5,577,299 | A | 11/1996 | Thompson et al. |
| 5,639,090 | A | 6/1997 | Stevens |
| 5,687,775 | A | 11/1997 | Thompson et al. |
| D389,050 | S | 1/1998 | Li |
| 5,713,094 | A | 2/1998 | Markey et al. |
| 5,888,392 | A | 3/1999 | Frizell |
| 5,927,764 | A | 7/1999 | Harriman |
| D425,784 | S | 5/2000 | Beugelsdyk et al. |
| 6,065,968 | A | 5/2000 | Corliss |
| D426,425 | S | 6/2000 | Hermanski |
| 6,122,859 | A | 9/2000 | Lazar |
| 6,129,551 | A | 10/2000 | Martin |
| 6,131,778 | A | 10/2000 | Etzion |
| 6,146,144 | A | 11/2000 | Fowler et al. |
| 6,149,436 | A | 11/2000 | Dunn |
| 6,171,317 | B1 | 1/2001 | Jackson et al. |
| 6,213,918 | B1 | 4/2001 | Rogers, Jr. |
| 6,550,177 | B1 * | 4/2003 | Epple, Jr. ..... 43/4 |
| D478,738 | S | 8/2003 | Workman |
| 6,880,364 | B1 | 4/2005 | Vidolin et al. |
| 6,923,026 | B1 | 8/2005 | Clarke |
| 7,040,120 | B2 | 5/2006 | Hunter |
| D552,463 | S | 10/2007 | French et al. |
| D570,923 | S | 6/2008 | Vazquez Gastellu |
| D578,383 | S | 10/2008 | Adams |
| 7,506,524 | B2 | 3/2009 | Gustin |
| D592,537 | S | 5/2009 | Darnell |
| 7,578,146 | B2 | 8/2009 | Gustin |
| 7,617,947 | B2 | 11/2009 | Schafer |
| D608,189 | S | 1/2010 | Jackson et al. |
| 7,909,609 | B2 | 3/2011 | Molin |
| 8,316,894 | B2 | 11/2012 | Schaub |
| 8,402,794 | B2 | 3/2013 | Sasur |
| 8,418,434 | B1 | 4/2013 | Carruth et al. |
| 8,485,565 | B2 | 7/2013 | Ng |
| D690,191 | S | 9/2013 | Takakuwa et al. |
| 8,622,441 | B1 | 1/2014 | Ng |
| 8,684,420 | B2 | 4/2014 | Ng |
| 2007/0114340 | A1 | 5/2007 | Adams |
| 2007/0199965 | A1 | 8/2007 | Gouldson |
| 2008/0156043 | A1 | 7/2008 | Gustin |
| 2008/0223083 | A1 | 9/2008 | Gustin |
| 2009/0215013 | A1 | 8/2009 | Molin |
| 2010/0019495 | A1 | 1/2010 | Oliveto |
| 2011/0152946 | A1 | 6/2011 | Frigg et al. |
| 2011/0259465 | A1 | 10/2011 | Schaub |
| 2012/0047960 | A1 | 3/2012 | Sasur |
| 2012/0112457 | A1 | 5/2012 | Ng |
| 2013/0020802 | A1 | 1/2013 | Ng |
| 2013/0300114 | A1 | 11/2013 | Ng |
| 2013/0307267 | A1 | 11/2013 | Ng |

FOREIGN PATENT DOCUMENTS

| | | |
|---|---|---|
| JP | 2004-520910 | 7/2004 |
| KR | 10-2001-0012609 | 2/2001 |
| KR | 10-2006-0042108 | 5/2006 |

OTHER PUBLICATIONS

International Search Report & Written Opinion for International Application No. PCT/US2011/041553 mailed on Feb. 23, 2012.

International Preliminary Report on Patentability for International Application No. PCT/US2011/041553 mailed on May 16, 2013.

Petition for Inter Partes Review of U.S. Patent No. 8,485,565 and Exhibits, filed in the United States Patent and Trademark Office.

How to Make Rubber Band Bracelets Using Twistz Bandz—Instruction #1; http://www.youtube.com/watch? v=6nInnVEjrLU; Mar. 28, 2011.

Various rubber band crafts and bracelets using Rainbow Loom®; http://www.youtube.com/watch?v=oM6sOkZFz5o; Mar. 30, 2011.

(56) References Cited

OTHER PUBLICATIONS

How to make "Diamond" pattern rubber band bracelet using the Rainbow Loom® Kit; http://www.youtube.com/watch?v=dZa8dpZasKA; Jun. 8, 2011.
(Rainbow Loom®) Twistz Bandz product—with bloopers; http://www.youtube.com/watch?v=DbzS5u8ib_0; Jul. 6, 2011.
Defendants' Preliminary Non-Binding Invalidity Contentions, *Choon's Design LLC* v. *Zenacon, LLC et al*., United States District Court for the Eastern District of Michigan, Case No. 2:13-cv-13568-PJD-RSW, Mar. 7, 2014.
Decision to Institute of Inter Partes Review of US Patent No. 8485565 dated May 20, 2014, Case IPR2014-00218, from the United States Patent and Trademark Office.
Petitioners Request for Rehearing Under 37 CFR §42.71(d) filed on Jun. 3, 2014, Case IPR2014-00218, from the United States Patent and Trademark Office.
United States Continuation U.S. Appl. No. 13/938,717, filed Jul. 10, 2013, entitled "Brunnian Link Making Device and Kit".
United States Continuation U.S. Appl. No. 14/329,099, filed Jul. 11, 2014 "Brunnian Link Making Device and Kit".
United States Continuation in Part U.S. Appl. No. 13/626,057, filed Sep. 25, 2012, entitled "Brunnian Link Making Device and Kit".
U.S. Appl. No. 14/331,456, filed Jul. 15, 2014, entitled "Hand Held Link Making Device and Kit".
U.S. Appl. No. 14/270,635, filed May 6, 2014, entitled "Device for Forming Brunnian Links".
Design U.S. Appl. No. 29/468,891, filed Oct. 24, 2013, entitled "Brunnian Link Forming Loom".
Design U.S. Appl. No. 29/468,549, filed Oct. 1, 2013, entitled "Brunnian Link Forming Loom".
Petition for Post-Grant Review of U.S. Patent No. 8,684,420 and Exhibits, filed in the United States Patent and Trademark Office on Aug. 5, 2014, Case No. PGR2014-00008.
Petition for Inter Partes Review of U.S. Patent No. 8,485,565 and Exhibits, filed in the United States Patent and Trademark Office on Aug. 20, 2014, Case No. IPR2014-01353.
European Search Report for EP Application No. 13840473.6 dated Jul. 3, 2014.
Takacas, Sarah (SarahLynnTea), How to Make Rubber Band Bracelets'; Published Apr. 15, 2009 http://www.youtube.com/watch?v=e0k762PJ-D8.
Introduction video—Rainbow Loom (the next generation Twistz Bandz kit). Published Sep. 24, 2012. http://www.youtube.com/watch?v=FUwf3CheGuw.
Lesson 21: "Sweet Heart" Rainbow Loom Bracelet by Choon; Published Jan. 21, 2013 http://www.youtube.com/watch?v=718MbYceECO.
Rainbow Loom from Choon's Design, LLC; Published Jul. 24, 2013 http://www.youtube.com/watch?v=vhiVxnbE0CE.
How to make a rainbow loom starburst bracelet; Published Aug. 1, 2013 http://www.youtube.com/watch?v=R17AkI5dJzo.
How to: Make the Rainbow Loom Single Band Bracelet; Published Aug. 12, 2013 http://www.youtube.com/watch?v=Wd3UdqPmKbA.
United Kingdom Combined Search and Examination Report for Application No. GB1416090.1 dated Oct. 16, 2014.
United Kingdom Combined Search and Examination Report for Application No. GB1416091.5 dated Oct. 16, 2014.
International Search Report and Written Opinion for International Application No. PCT/US14/46106 mailed Oct. 18, 2014.
International Search Report and Written Opinion for International Application No. PCT/US14/54475 mailed Oct. 27, 2014.

* cited by examiner

MONSTER TAIL LOOM FOR FORMING BRUNNIAN LINKS

CROSS REFERENCE TO RELATED APPLICATIONS

This claims priority to U.S. Provisional Application No. 61/877,490 filed Sep. 13, 2013.

BACKGROUND

This disclosure generally relates to method and device for creating a linked item. More particularly, this disclosure relates to a method and device for creating a linked wearable item from elastic bands.

Kits that include materials for making a uniquely colored bracelet or necklace have always enjoyed some popularity. However such kits usually just include the raw materials such as different colored threads and beads and rely on the individual's skill and talent to construct a usable and desirable item.

Accordingly there is a need and desire for a kit that provides not only the materials for creating a unique wearable item, but also that provides for ease of construction to make it easy for people of many skill and artistic levels to successfully create a desirable and durable wearable item.

SUMMARY

A Brunnian link is a link formed from a closed loop doubled over itself to capture another closed loop to form a chain. Elastic bands can be utilized to form such links in a desired manner. The example device provides a means of creating items using Brunnian links of complex configurations. Moreover, the example device that provides for the successful creation of unique wearable items regardless of skill level.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
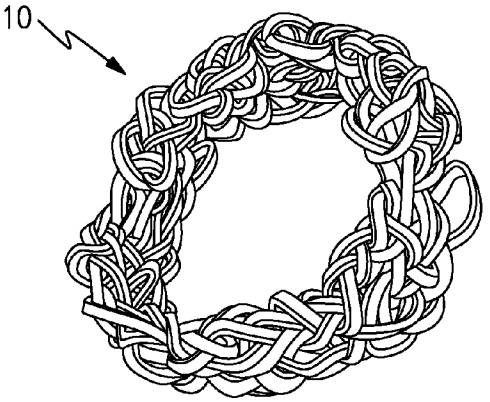
FIG. 1 is a schematic view of an example linked article.
Figure 2:
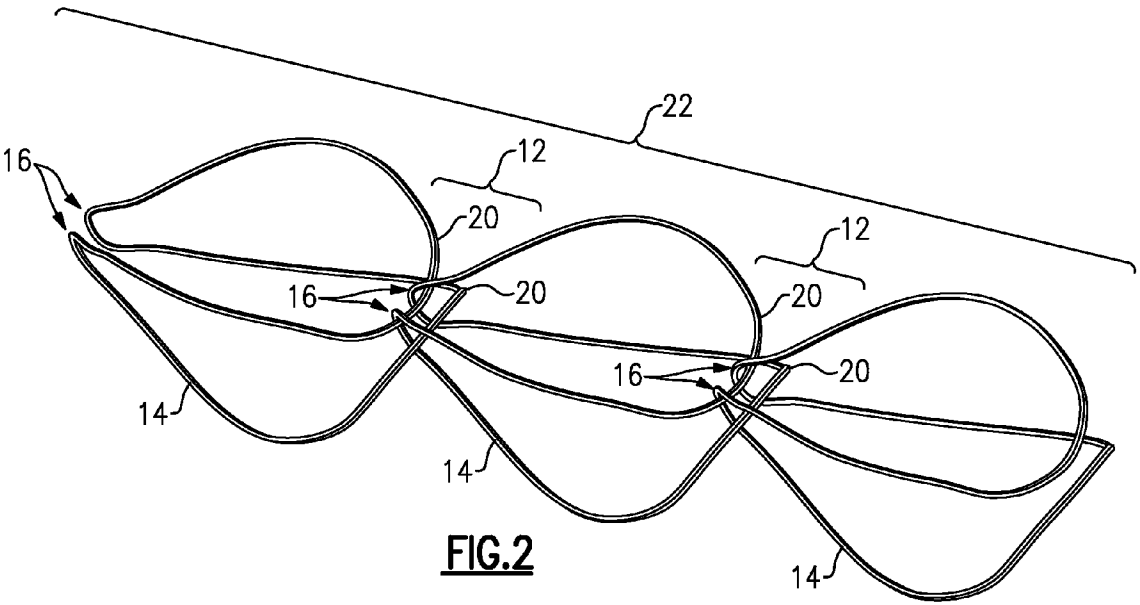
FIG. 2 is a schematic view of an example chain formed from Brunnian links utilizing elastic bands.

Referring to FIGS. 1 and 2, a Brunnian link 12 is formed from a continuous looped structure 14 without forming an actual knot. Several links 12 are formed into a chain 22 to form a linked article such as a bracelet. The ends are then secured and a durable wearable item 10 is created. In this example three closed looped elastic bands 14 such as rubber bands are shown forming a single chain 22. Capturing ends 16 of one elastic band 14 with a mid portion 20 another elastic band 14 forms each link 12. Each link 12 depends on the previous and subsequent links 14 to maintain the desired linked article.

Figures 3, 4, 5, 6, 7:
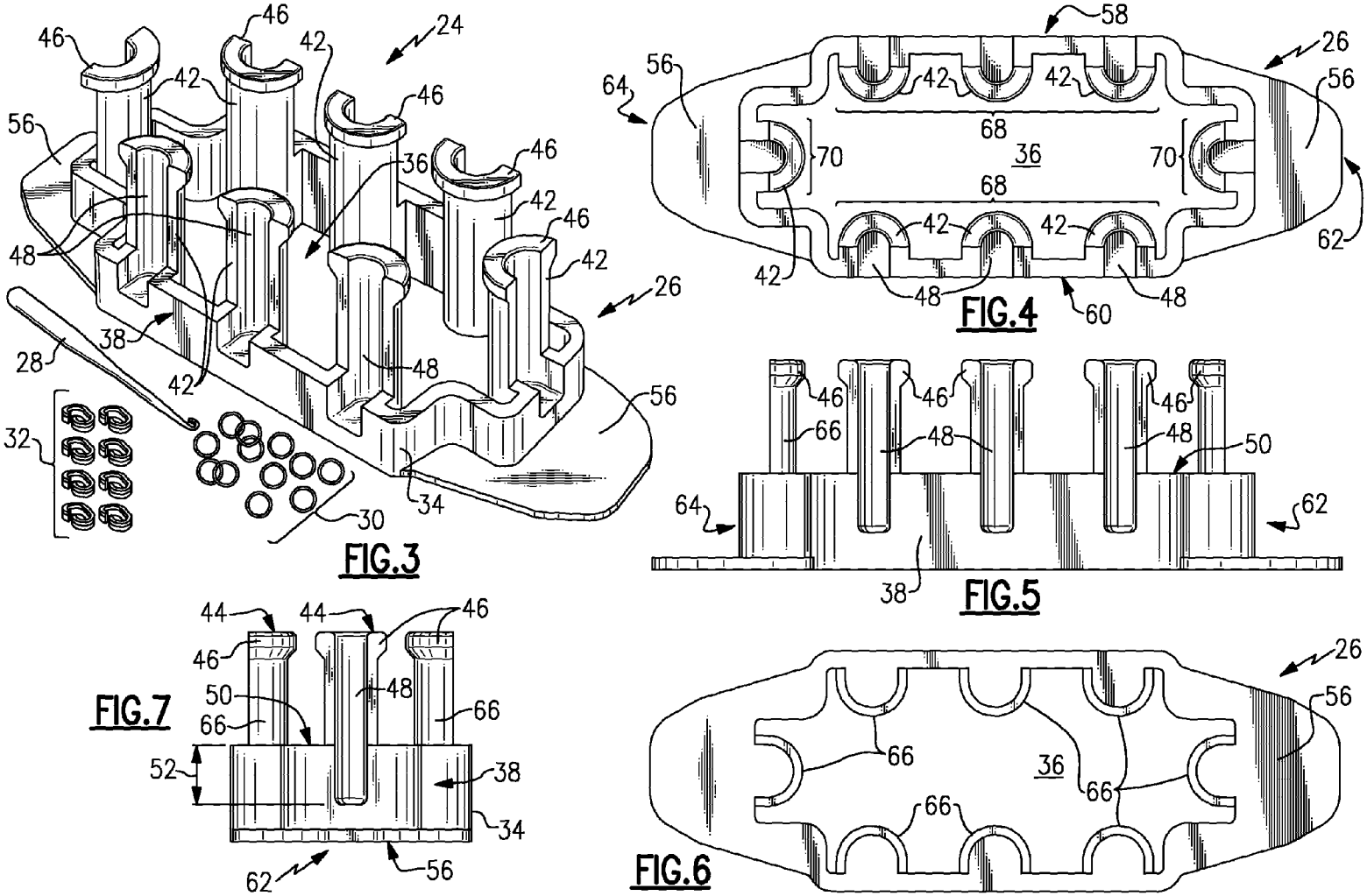
FIG. 3 is a perspective view of an example kit including an example loom.
FIG. 4 is a top view of the example loom.
FIG. 5 is a side view of the example loom.
FIG. 6 is a bottom view of the example loom.
FIG. 7 is an end view of the example loom.

Referring to FIG. 3 an example kit 24 for creating Brunnian link items such as bracelets and other wearable or decorative items includes a loom 26, a hook 28, a plurality of clips 32 and a plurality of elastic bands 30. The loom 26 includes a base 34 supporting a plurality of upward extending pins 42. Each of the pins 42 includes a flange 46 near a top surface 44 (FIG. 7) for holding an elastic band 30 in a desired orientation. Each of the pins 42 includes an access groove 48 extending through the top surface 44 and the flange 46. The access groove 48 extends through the flange 46 to provide access for the hook 28 through the top surface 44 to grasp a lower elastic band 30 and pull it through an upper elastic band supported on adjacent pins 42. Each of the access grooves 48 faces outward from the base 34.

Referring to FIGS. 4-7 with continued reference to FIG. 3, the base 34 is generally rectangular shaped with a first side 58, a second side 60, a first end 62 and a second end 64. The first and second sides 58, 60 include a first quantity 68 of pins 42 and the first and second ends include a second quantity 70 of pins 42 that is less than the first quantity 68 of pins 42. In one example, each of the first quantity 68 and the second quantity 70 are odd numbers. In this example the first quantity 68 of pins 42 on each of the first and second sides 58, 60 includes 3 pins and the second quantity 70 of pins 42 on the first and second ends 62, 64 includes one pin 42. Each of the pins 42 extend upward from the base 34. It should be appreciated that different numbers of pins could be utilized on each of the sides to provide different patterns and are within the contemplation of this disclosure.

The base 34 includes a top surface 50 and a wall 38 around an outer periphery about which each of the plurality of pins 42 is located. The access groove 48 extends through the top surface 44 of each of the pins 42 downward a distance 52 past the top surface 50 into the wall 38. The access groove 48 extending below the top surface 50 of the base 34 provides for a hook 28 to enter the access groove 48 somewhere below the top surface 50 and a lower most elastic band 30 that is supported on one of the plurality of pins 42. The top surface 50 of the base 34 limits how far an elastic band 30 can be pushed downward on the pin 42, the distance 52 of the access groove below the top surface eases access to the access groove 48 and thereby a lower most elastic band 30 that may abut against the surface 50 of the base 34.

Each of the access grooves 48 faces outwardly from the wall 38 about the outer periphery of the base 34. Accordingly, the pins 42 on the first side 58 are open in a first direction; pins 42 on the second side 60 are open in a second direction opposite the first direction. Pins 42 on the first end 62 are open outward from the first end 62 and the pin 42 on the second end 64 is open outwardly in a direction opposite the first end.

The wall 38 of the base 34 surrounds an interior space 36 through which a completed portion of a linked article can extend during fabrication. Pins 42 on each of the first side 58 and the second side 60 are aligned with each other across the interior space 36. Each of the pins 42 includes a body portion 66 on a side opposite the access groove 48. The body portion 66 of each of the pins 42 protrudes into the inner space 36. The base 34 also includes tab portions 56 extending from each of the first and second ends 62, 64 to aid in holding the loom during creation of a linked article.

Figure 8C:
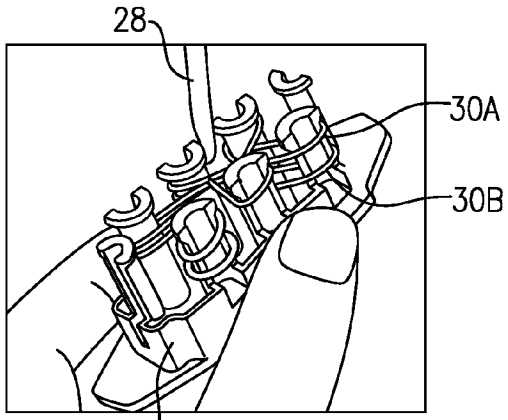
FIG. 8C is a schematic view of yet another method step for creating a linked article.
Figure 8B:
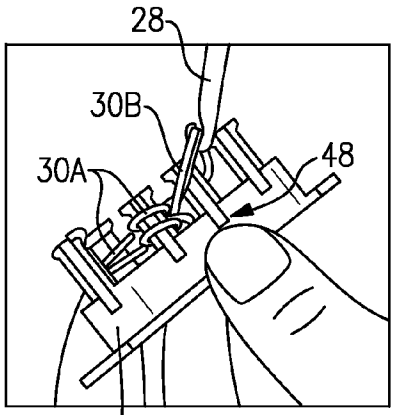
FIG. 8B is a schematic view of another method step for creating a linked article.
Figure 8A:
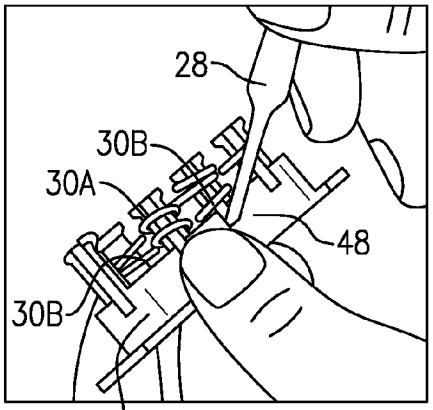
FIG. 8A is a schematic view of a method step for creating a linked article with the example loom.

Referring to FIG. 8A-C with continued reference to FIGS. 3-7, the access grooves 48 provide the hook 28 tool to grasp and capture one portion of a lower most elastic band 30. A method of creating a linked item from closed loop elastic bands utilizing the example loom 26 includes assembling an elastic band 30 across at least two pins 42. In this example, the upper most elastic band is indicated as 30A and the lower most elastic band is indicated as 30B. Assembling the elastic band 30 includes stretching over at least two of the plurality of pins 42. The at least two pins 42 can be any combination of pins 42 from the first side 58, the second side 60, the first end 62 and the second end 64. Additional elastic bands 30 are assembled to the pins 42 with at least some of the additional bands being placed on the same pins 42.

A portion of a lower elastic band 30B is captured utilizing the hook 28 extended into the access groove 48 (FIG. 8A). The captured band 30B is then pulled over at least one of the elastic bands 30A on the same pin 42 (FIG. 8B). Note that although one upper elastic band 30A is described, several upper elastic bands may be provided to form a desired linked structure. A lower most elastic band 30B would then be grasped and pulled over all of the upper elastic bands 30A. The process is repeated with different pins 42 around the loom 26. Additional elastic bands 30 are added and the process repeated to form a desired linked structure from closed loop elastic bands. The completed or linked part of the article is feed through the interior space 36 as additional links are added to create the linked item.

Another disclosed method of creating a linked item utilizing the loom 26 includes the step of stretching a plurality of elastic bands 30 across at least two adjacent pins 42. In one example, a first or lower elastic band 30B is stretched across pins 42 directly across from each other. A second or upper elastic band 30A is then stretched across an outer perimeter of each of the bands and located atop the previously placed lower elastic bands 30B. The lower most elastic band 30B on each pin 42 is grasped with the hook 28 through the access groove 48 and pulled over the upper most bands 30A. The process is repeated as the length of the linked article extends downward through the open space 36 in the base 34 of the loom. The flange 46 at the top surface 44 of the pins 42 holds the upper elastic bands 30A in place as each of the lower elastic bands 30B are stretched over the upper bands 30A. The process is repeated by adding more bands until a desired length of a linked article is attained.

Figure 9:
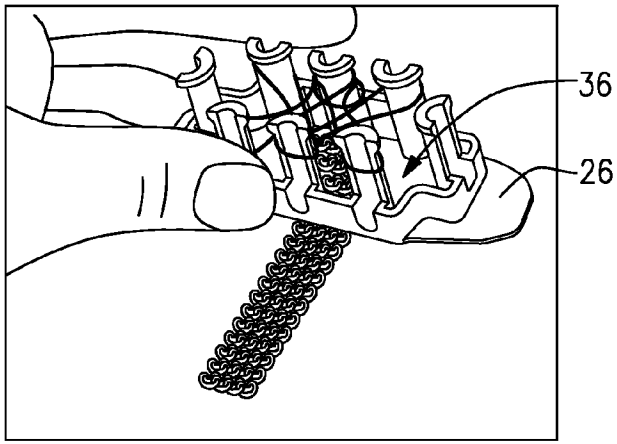
FIG. 9 is a schematic view of a formation of a linked article with the example loom.

Referring to FIG. 9, the linked article is formed by creating successive Brunnian links in a desired pattern that extends through the interior space 36 of the loom 26 as is illustrated in FIG. 9. Different patterns utilizing Brunnian links can be utilized to create a desired lined article.

Accordingly, the example loom and method provide for the creation of many different combinations and configurations of Brunnian links for the creation of bracelets, necklaces, and other wearable items.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A loom for creating a linked item from a plurality of closed loops, the device comprising:

a base defining an inner space, a top surface and an outer periphery; and a plurality of pins disposed about the outer periphery of the base, each of the plurality of pins includes a flange at a top surface of each of the plurality of pins for holding an elastic band in place and an access groove that extends through the top surface of each of the plurality of pins and the flange and into the outer periphery of the base below the top surface of the base.

2. The loom as recited in claim 1, wherein each of the access grooves open outwardly about the outer periphery of the base.

3. The loom as recited in claim 2, wherein the loom includes a first side and a second side each including a first quantity of the plurality of pins, wherein the loom further includes a first end and a second end that each include a second quantity of the plurality of pins that is less than the first quantity.

4. The loom as recited in claim 3, wherein the first quantity and the second quantity comprise an odd number.

5. A loom for creating a linked item from a plurality of closed loops, the device comprising:

a base defining an inner space, a top surface and an outer periphery; and a plurality of pins disposed about the periphery of the base, each of the plurality of pins includes a flange for holding an elastic band in place and an access groove that extends through the flange along the pin and into the outer periphery of the base, wherein the loom includes a first side and a second side each including three pins, wherein the loom further includes a first end and a second end that each include one pin.

6. The loom as recited in claim 3, wherein each of the pins on the first side and the pins on the second side are aligned across the inner space.

7. The loom as recited in claim 3, wherein the pins on the first end and the pins on the second end are aligned across the inner space.

8. The loom as recited in claim 3, wherein the access groove for each of the pins on the opposing sides of the inner space are open in an opposite directions.

9. The loom as recited in claim 1, wherein each of the plurality of pins includes a body portion on a side opposite the access groove that protrudes into the inner space.

10. The loom as recited in claim 1, wherein each of the plurality of pins extends upright from the base.

11. The loom as recited in claim 1, including tabs that extend outward from opposing ends of the base.

12. A loom for creating a linked item from a plurality of closed loops, the device comprising:

a base defining an inner space, a top surface and an outer periphery; and a plurality of pins disposed about the outer periphery of the base, each of the plurality of pins includes an access groove that extends along the pin and into the outer periphery of the base and a flange near a top surface of each of the plurality of pins, wherein the access groove extends through the top surface of the plurality of pins and the flange of each of the plurality of pins and the access groove extends below the top surface of the base.

13. The loom as recited in claim 12, wherein each of the access grooves open outwardly about the outer periphery of the base.

14. The loom as recited in claim 13, wherein the loom includes a first side and a second side each including a first quantity of the plurality of pins, wherein the loom further includes a first end and a second end that each include a second quantity of the plurality of pins that is less than the first quantity.

15. The loom as recited in claim 12, wherein each of the plurality of pins extends upright from the base.

16. The loom as recited in claim 12, including tabs that extend outward from opposing ends of the base.

* * * * *